US012760623B2

(12) United States Patent
Begnaud

(10) Patent No.: US 12,760,623 B2
(45) Date of Patent: Oct. 13, 2026

(54) TUBULAR STRING SHROUD SYSTEM

(71) Applicant: Expro North Sea Limited, Dyce (GB)

(72) Inventor: Brian D. Begnaud, Lafayette, LA (US)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 19/236,546

(22) Filed: Jun. 12, 2025

(65) Prior Publication Data

US 2025/0382849 A1 Dec. 18, 2025

Related U.S. Application Data

(60) Provisional application No. 63/659,140, filed on Jun. 12, 2024.

(51) Int. Cl.

| | |
|---|---|
| ***E21B 41/00*** | (2006.01) |
| ***E21B 17/02*** | (2006.01) |
| ***E21B 17/10*** | (2006.01) |
| ***E21B 19/10*** | (2006.01) |
| *E21B 19/08* | (2006.01) |

(52) U.S. Cl.

CPC ..... *E21B 41/0021* (2013.01); *E21B 17/026* (2013.01); *E21B 17/1035* (2013.01); *E21B 19/10* (2013.01); *E21B 19/08* (2013.01)

(58) Field of Classification Search

None

See application file for complete search history.

(56) References Cited

U.S. PATENT DOCUMENTS

| | | | | |
|---|---|---|---|---|
| 6,920,931 | B1 * | 7/2005 | Webre | E21B 19/22 166/77.1 |
| 7,571,764 | B1 * | 8/2009 | Sammann | E21B 19/10 166/94.1 |
| 2006/0108122 | A1 * | 5/2006 | Buytaert | E21B 17/026 166/77.52 |
| 2008/0264650 | A1 * | 10/2008 | Begnaud | E21B 19/00 166/85.5 |
| 2010/0059231 | A1 * | 3/2010 | Thomas | E21B 19/10 166/380 |
| 2011/0147008 | A1 * | 6/2011 | Brown | E21B 19/08 166/85.5 |
| 2012/0090828 | A1 * | 4/2012 | Webre | E21B 17/026 29/428 |
| 2013/0186640 | A1 * | 7/2013 | Webre | E21B 19/08 166/85.5 |
| 2015/0034295 | A1 * | 2/2015 | Osborne | E21B 41/0021 166/75.11 |
| 2024/0271493 | A1 * | 8/2024 | Begnaud | E21B 19/165 |

* cited by examiner

*Primary Examiner* — Blake Michener

(74) *Attorney, Agent, or Firm* — Getz Balich LLC

(57) ABSTRACT

A shroud system for a tubular string clamping device on a well platform is provided. The clamping device has a door pocket. The shroud system includes a cover frame and a cover door. The cover frame is configured to engage with the door pocket of the clamping device. The cover frame is also configured to define an access opening relative to the door pocket for access to an interior of the tubular string clamping device. The cover door is pivotally attached to the cover frame, and is pivotable between an open position and a closed position. The cover frame and the cover door are configured such that in the open position the access opening is uncovered thereby providing a passage through the door pocket and into the interior of the tubular string clamping device, and in the closed position access opening is covered by the cover door.

20 Claims, 10 Drawing Sheets

TUBULAR STRING SHROUD SYSTEM

This application claims priority to U.S. Patent Appln. No. 63/659,140 filed Jun. 12, 2024 which is hereby incorporated herein by reference in its entirety.

BACKGROUND OF THE INVENTION

1. Technical Field

The present disclosure relates to oil well tubular string equipment in general, and to protective equipment for oil well tubular string equipment in particular.

2. Background Information

Tubing spiders are used in the oil industry to grip a tubular string during assembly or disassembly of the tubular string. The term "tubular string" as used herein refers to tubular structures such as drill strings, casings, and the like that may be used in oil and gas wells. The tubular string extends through a hole in a well drilling platform and into a casing that is disposed below the well platform. The spider includes a plurality of gripping elements ("grippers") that engage with the tubular string to hold the tubular string. During the process of assembling and inserting the tubular string into the casing, for example, an elevator initially holds the tubular and is operated to lower the tubular string into the casing. As the tubular string approaches the well platform during the lowering process, the spider is operated to grip and hold the tubular string to allow the elevator to release the string. Subsequently, another string section is attached to the existing tubular string using the elevator and a tong. Once the new tubular string section is attached, the tong is removed from the string, the elevator resumes supporting the string, and the spider is released. The lowering process is resumed and repeated as additional tubular string sections are added.

Very often one or more control lines are clamped to the tubular string to permit the control lines to be lowered into the casing with the tubular string. The control lines may house communication lines or the like for communication with and/or for actuating downhole devices. The process of attaching the control lines typically uses a control line manipulating arm ("CLMA") to position the control lines relative to the tubular string to permit the control line(s) to be clamped to the tubular string.

A person skilled in the art will recognize that it is important to prevent foreign objects falling through the well platform around the tubular string. Foreign objects falling through the well platform ("foreign object incursion") can create hazards for well personnel and can enter the well and cause damage therein. What is needed is a device that protects against foreign object incursion.

SUMMARY

According to an aspect of the present disclosure, a shroud system for a tubular string clamping device on a well platform is provided. The clamping device has a door pocket. The shroud system includes a cover frame and a cover door. The cover frame is configured to engage with the door pocket of the clamping device. The cover frame is also configured to define an access opening relative to the door pocket for access to an interior of the tubular string clamping device. The cover door is pivotally attached to the cover frame, and is pivotable between an open position and a closed position. The cover frame and the cover door are configured such that in the open position the access opening is uncovered thereby providing a passage through the door pocket and into the interior of the tubular string clamping device, and in the closed position access opening is covered by the cover door.

In any of the aspects or embodiments described above and herein, the cover frame may include a first enclosure panel disposed on a first lateral side of the access opening, and a second enclosure panel that is disposed on a second lateral side of the access opening.

In any of the aspects or embodiments described above and herein, the cover frame may include a first lateral side panel that is attached to the first enclosure panel and that extends laterally outward from the first enclosure panel, and a second lateral side panel that is attached to the second enclosure panel and that extends laterally outward from the second enclosure panel.

In any of the aspects or embodiments described above and herein, the cover door may extend between the first enclosure panel and the second enclosure panel.

In any of the aspects or embodiments described above and herein, the cover frame may include a first lateral side panel that extends in a first lateral direction from the access opening and a second lateral side panel that extends in a second lateral direction from the access opening.

In any of the aspects or embodiments described above and herein, the cover door may include a base end and a distal end, and the cover door may be pivotally attached to the cover frame adjacent the base end.

In any of the aspects or embodiments described above and herein, the cover door may include a wall section and a top section. The wall section may extend from the base end to the top section, and the top section may extend from the wall section to the distal end. In the closed position, the wall section may cover at least a portion of a wall portion of the access opening and the top section may cover at least a portion of a top portion of the access opening.

In any of the aspects or embodiments described above and herein, the shroud system may include a flexible member attached to the distal end of the cover door. The flexible member may be configured to engage with a tubular string disposed within the tubular string clamping device when the cover door is disposed in the closed position.

In any of the aspects or embodiments described above and herein, the shroud system may include a seal member configured to engage with a tubular string disposed within the tubular string clamping device when the cover door is disposed in the closed position.

In any of the aspects or embodiments described above and herein, the shroud system may include an actuator that is controllable to pivot the cover door between the open position and the closed position.

According to an aspect of the present disclosure, a shroud system for a well drilling platform system is provided. The well drilling platform system includes a tubular string clamping device and a control line manipulating arm (CLMA) device. The tubular string clamping device has a door pocket and is controllable to clamp a tubular string. The CLMA device includes an arm that may be pivoted between an arm-up configuration and a docked configuration. The shroud system includes a clamping device shroud and a seal device. The clamping device shroud includes a cover frame and a cover door. The cover frame is configured to engage with the door pocket of the clamping device. The cover frame is configured to define an access opening relative to the door pocket for access to an interior of the tubular string clamping device. The cover door is pivotally attached to the cover frame, and is pivotable between an open position and a closed position. The cover frame and the cover door are configured such that in the open position the access opening is uncovered thereby providing a passage through the door pocket and into the interior of the tubular string clamping device, and in the closed position access opening is covered by the cover door. The seal device is attached to the arm of the CLMA device. The seal device is configured to engage with a tubular string disposed within the tubular string clamping device when the arm of the CLMA device is disposed in the docked configuration.

In any of the aspects or embodiments described above and herein, the seal device may be disengaged with the tubular string when the arm of the CLMA device is disposed in the arm-up configuration.

In any of the aspects or embodiments described above and herein, the seal device may include a slot that is configured to receive the tubular string when the arm of the CLMA device is in the docked configuration.

In any of the aspects or embodiments described above and herein, the seal device may include a first seal segment and a second seal segment that are configured to be disposed in a closed configuration in which the first seal segment and the second seal segment are engaged with the tubular string, or in an open configuration in which the first seal segment and the second seal segment are not engaged with the tubular string.

In any of the aspects or embodiments described above and herein, the first seal segment and the second seal segment may be pivotally mounted and may be configured to pivot between the closed configuration and the open configuration.

In any of the aspects or embodiments described above and herein, the shroud system may include a seal member actuator that is controllable to actuate the first seal segment and the second seal segment between the closed configuration and the open configuration.

In any of the aspects or embodiments described above and herein, the cover door may include a wall section and a top section, and the wall section may extend from the base end to the top section, and the top section may extend from the wall section to the distal end, and in the closed position, the wall section may cover at least a portion of a wall portion of the access opening and the top section may cover at least a portion of a top portion of the access opening.

In any of the aspects or embodiments described above and herein, the shroud system may include a flexible member attached to the cover door, and the flexible member may be configured to engage with a tubular string disposed within the tubular string clamping device when the cover door is disposed in the closed position.

In any of the aspects or embodiments described above and herein, the shroud system may include an actuator that is controllable to pivot the cover door between the open position and the closed position.

According to an aspect of the present disclosure, a shroud system for a tubular string clamping device on a well platform is provided. The clamping device has a door pocket. The shroud system includes a pivotally mounted cover door and an actuator. The pivotally mounted cover door is disposable in an open position and in a closed position. In the open position, the door pocket is uncovered thereby providing a passage through the door pocket and into an interior of the tubular string clamping device. In the closed position, the cover door is disposed to cover the door pocket. The actuator is controllable to actuate the cover door between the open position and the closed position.

The foregoing features and elements may be combined in various combinations without exclusivity, unless expressly indicated otherwise. For example, aspects and/or embodiments of the present disclosure may include any one or more of the individual features or elements disclosed above and/or below alone or in any combination thereof. These features and elements as well as the operation thereof will become more apparent in light of the following description and the accompanying drawings. The following description and drawings are intended to be exemplary in nature and non-limiting.

BRIEF DESCRIPTION OF THE DRAWINGS

FIG. 1 illustrates the control line manipulating arm in an arm-up configuration and FIG. 1A illustrates the control line manipulating arm in a docked configuration.

DETAILED DESCRIPTION

Figure 1:
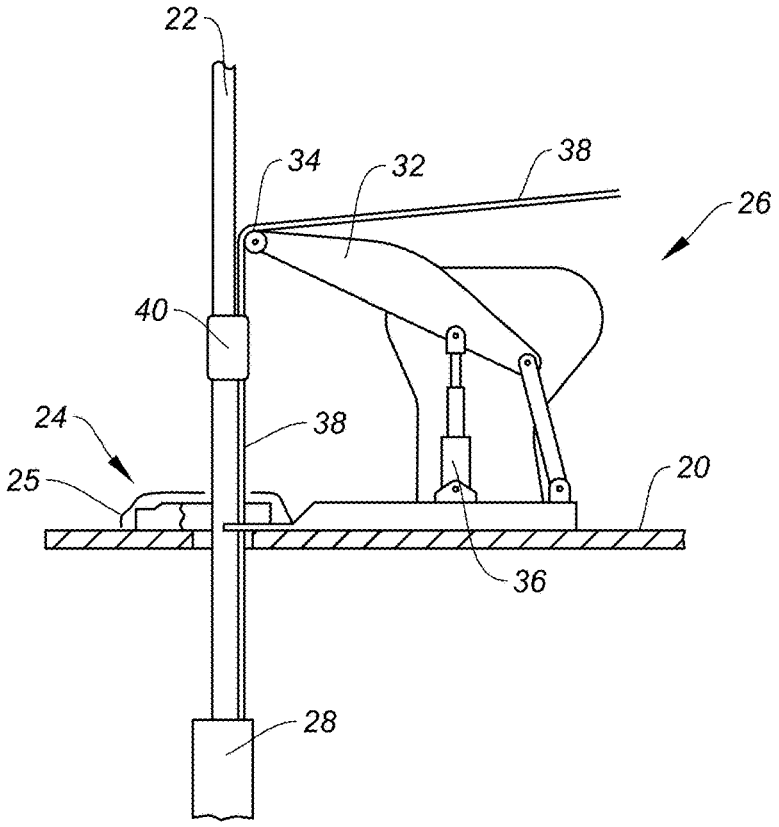
FIGS. 1 and 1A are diagrammatic illustrations of an oil well platform with a tubular string, a spider, and a control line manipulating arm.
Figure 1A:
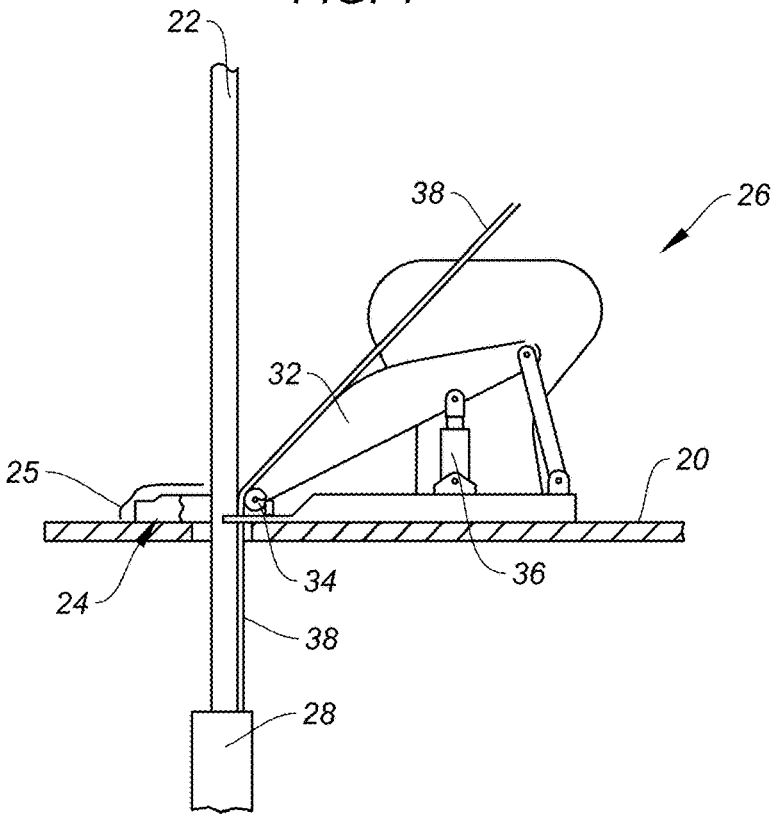

FIGS. 1 and 1A diagrammatically illustrate an oil well platform structure 20 with a tubular string 22, a tubular string clamping device (referred to hereinafter as a "spider 24"), and a control line manipulating arm (i.e., "CLMA 26") disposed relative to a well casing 28. The tubular string 22 extends through the well platform structure 20 and into the well casing 28 disposed below the well platform structure 20. The tubular string 22 may be described as extending along a vertical axis. Below the platform structure 20, the well casing 28 extends into the well bore (not shown) of the oil well. A barber collar 25 (a known form of a spider cover device) is also shown in FIGS. 1 and 1A disposed to cover the spider 24. FIG. 1 diagrammatically illustrates the CLMA 26 disposed in an "arm-up" configuration. FIG. 1A diagrammatically illustrates the CLMA 26 disposed in a "docked" configuration.

As described above, the process of assembling and inserting the tubular string 22 into the well casing 28 typically uses an elevator (not shown) to support the tubular string 22 during the assembly and insertion process. As the tubular string 22 is being lowered through the well platform structure 20 during the lowering process, the spider 24 is operated to grip and hold the tubular string 22 to allow the elevator to release the string 22. Subsequently, another string section is attached to the existing tubular string 22 using the elevator and a tong (not shown). Once the new tubular string section is attached, the tong is removed from the string, the elevator resumes supporting the string 22, and the spider 24 is released. The lowering process is resumed and repeated as additional tubular sections are added to the string 22.

Figure 2:
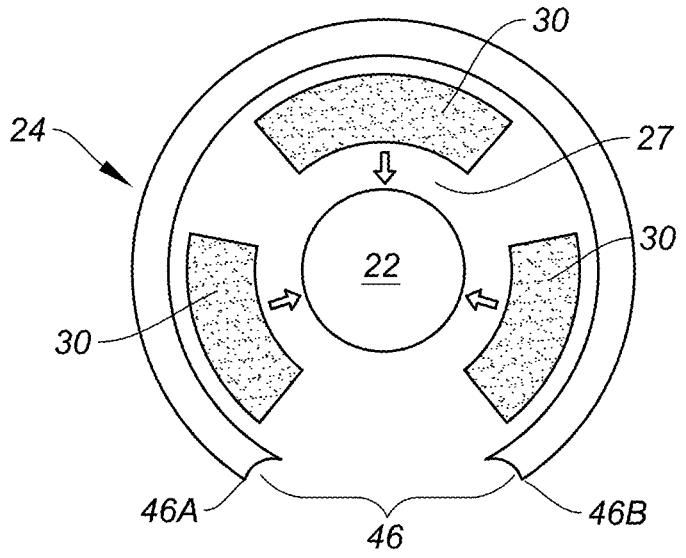
FIG. 2 is a diagrammatic view of a tubular string spider, showing the grippers.

Referring to FIG. 2, the spider 24 includes gripping members ("grippers 30") that can be engaged with the tubular string 22 to secure the tubular string 22 when the elevator is disengaged with the tubular string 22 during the string assembly process. FIG. 2 diagrammatically illustrates a tubular string 22 extending through a spider 24 with the grippers 30 retracted in a disengaged configuration. In the disengaged configuration, an open annular region 27 surrounds the tubular string 22. The grippers 30 are actuable (e.g., mechanically, pneumatically, hydraulically, or the like) between the shown disengaged position and a radially inward engaged position, wherein the grippers 30 move into engagement with the tubular string 22 as indicated by the arrows in FIG. 2. The present disclosure may be utilized with a variety of different spider types and configurations and is not therefore limited to any particular spider configuration.

Referring back to FIGS. 1 and 1A, the CLMA 26 has an arm 32 with a roller head 34 disposed at a distal end of the arm 32. The arm 32 is pivotally mounted and can be actuated vertically up or down. In the embodiment shown in FIG. 1, fluid power cylinders 36 (e.g., hydraulic or pneumatic) are used to pivotally actuate the CLMA arm 32. Control lines 38 may be fed into the CLMA 26 and the CLMA 26 operates to position the control lines 38 relative to the tubular string 22. In an "arm-up" configuration (e.g., as shown in FIG. 1), the CLMA 26 may be operated to dispose the control lines 38 in close proximity to the tubular string 22. In a "docked" configuration (e.g., as shown in FIG. 1A), the CLMA arm 32 is disposed with the roller head 34 adjacent the spider 24. In the docked position, the roller head 34 of the CLMA 26 draws the control lines 38 away from the tubular string 22 to a position wherein the control lines 38 will not interfere with the spider grippers 30 (see FIG. 2) transitioning from the disengaged position to the engaged position or vice versa. Once another string section is attached to the existing tubular string 22 and the tubular string 22 is again supported by the elevator, the spider 24 is disengaged from the tubular string 22 (e.g., the grippers 30 move from the engaged position to the disengaged position), and the CLMA arm 32 is pivoted from the docked configuration to the arm-up configuration, maintaining the control lines 38 in close proximity to the tubular string 22. The control lines 38 may be subsequently secured to the tubular string 22 using one or more control line clamps 40 (see FIG. 1). The tubular string 22 (and attached control lines 38) may be subsequently lowered through the platform structure 20 and into the well casing 28 and the process repeated.

As stated above, it is critical that no foreign objects (e.g., tools, hardware, debris, or the like) be allowed to fall through the well platform structure 20; e.g., through the annular space surrounding the tubular string 22. The present disclosure provides a novel and unobvious system for shrouding the region surrounding the tubular string 22 that decreases (or eliminates) the possibility of foreign object incursion into the region proximate the spider 24 and through the well platform structure 20.

Figure 3:
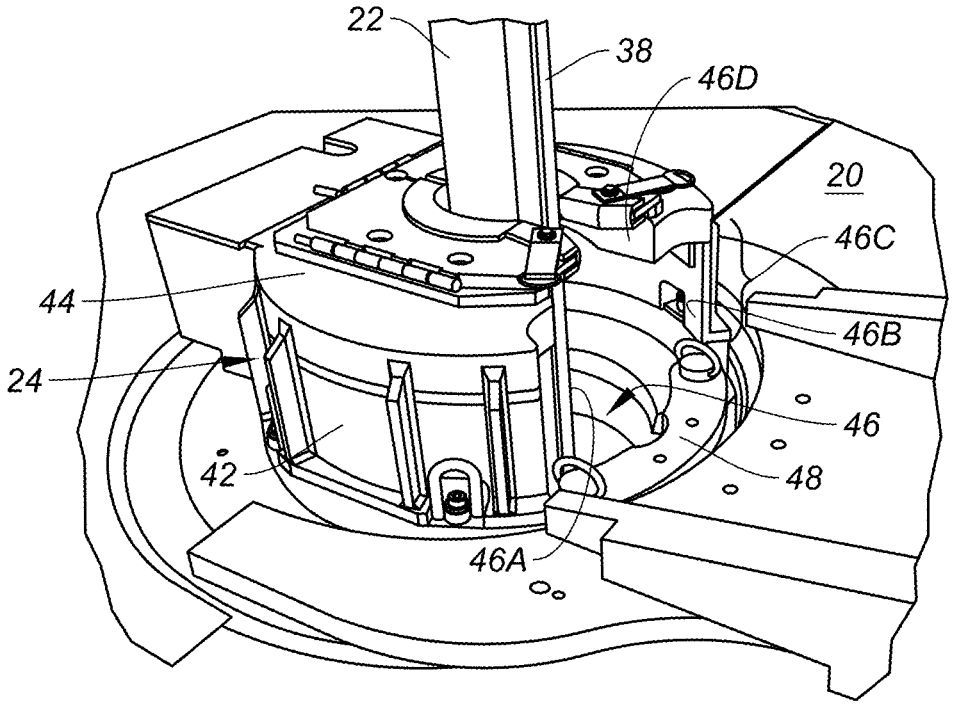
FIG. 3 is a diagrammatic views of a tubular string spider.
Figure 4:
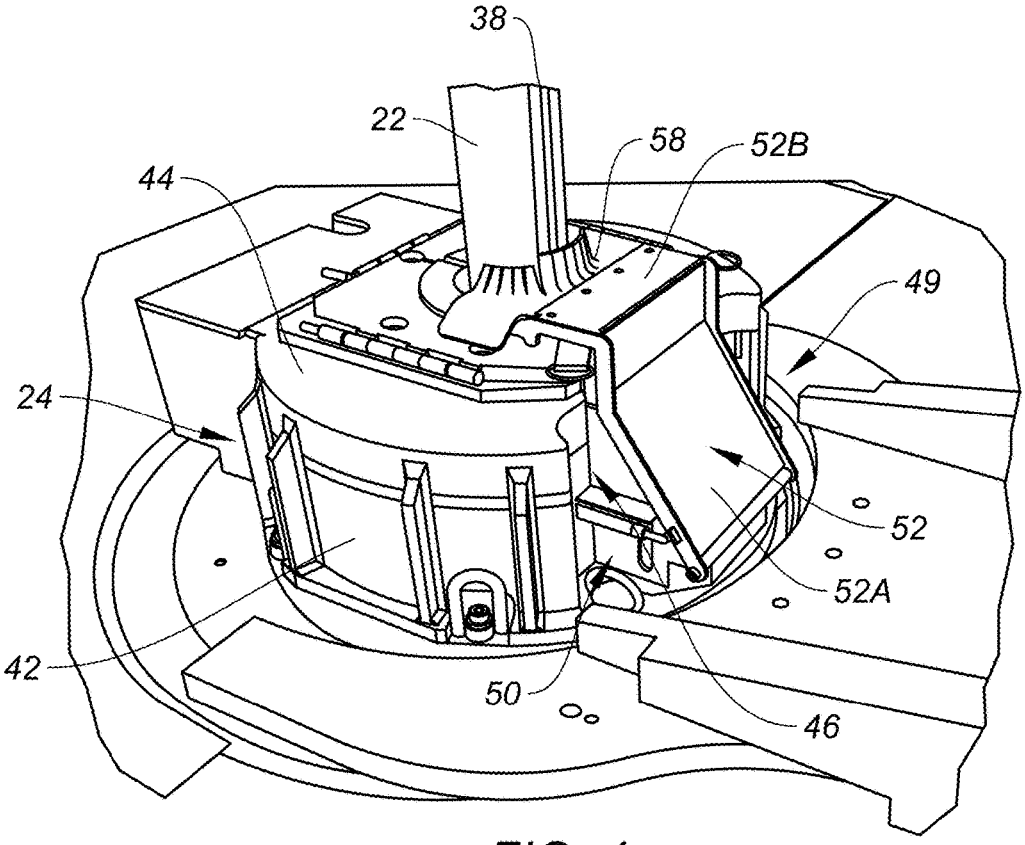
FIG. 4 is a diagrammatic view of a present disclosure shroud system embodiment.

FIG. 3 is a diagrammatic illustration of a spider 24 positioned relative to a well platform structure 20 with a tubular string 22 extending through the spider 24 and the well platform structure 20. The spider 24 may be described as having an outer wall 42, a top panel 44, and a spider door pocket 46. As can be seen in the spider 24 embodiment diagrammatically shown in FIG. 4, the outer wall 42 may extend in a general vertical direction and the top panel may be disposed in a generally horizontal plane; i.e., the top panel 44 may be generally perpendicular to the outer wall 42. The spider door pocket 46 may include a wall portion 46C and a top panel portion 46D. The wall portion 46C is aligned with the outer wall 42 and the top panel portion 46D is aligned with the top panel 44. The top panel portion 46D of the pocket 46 provides an open passage between a central aperture that receives the tubular string 22 and the wall portion 46C of the pocket 46. The wall portion 46C of the spider door pocket 46 extends between a first lateral side 46A and a second lateral side 46B. A pivotally mounted spider base door 48 extends between the first and second lateral sides 46A, 46B. FIG. 4 illustrates the spider base door 48 in a closed position.

The present invention is directed to a tubular string shroud system 49 that includes a plurality of system elements. The tubular string shroud system elements shroud the interior portion of the spider 24 and thereby prevent foreign object incursion into the open region surrounding the tubular string 22.

Figure 5:
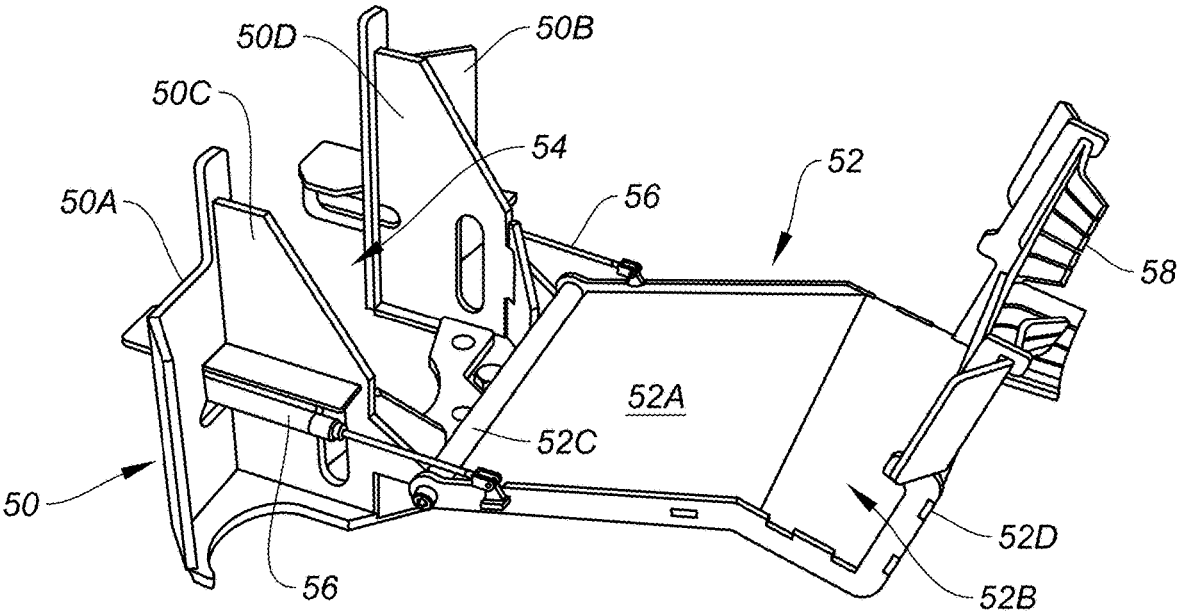
FIG. 5 is a diagrammatic view of a present disclosure shroud system embodiment shown in an open position.
Figure 6:
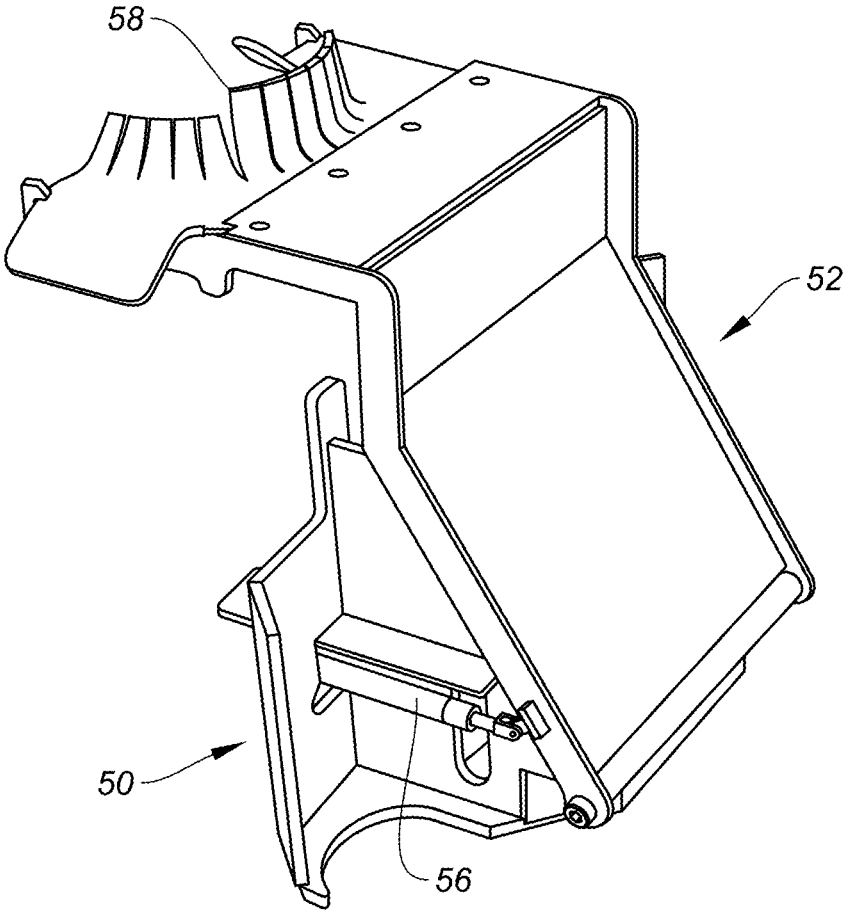
FIG. 6 is a diagrammatic view of a present disclosure shroud system embodiment shown in a closed position.
Figure 7:
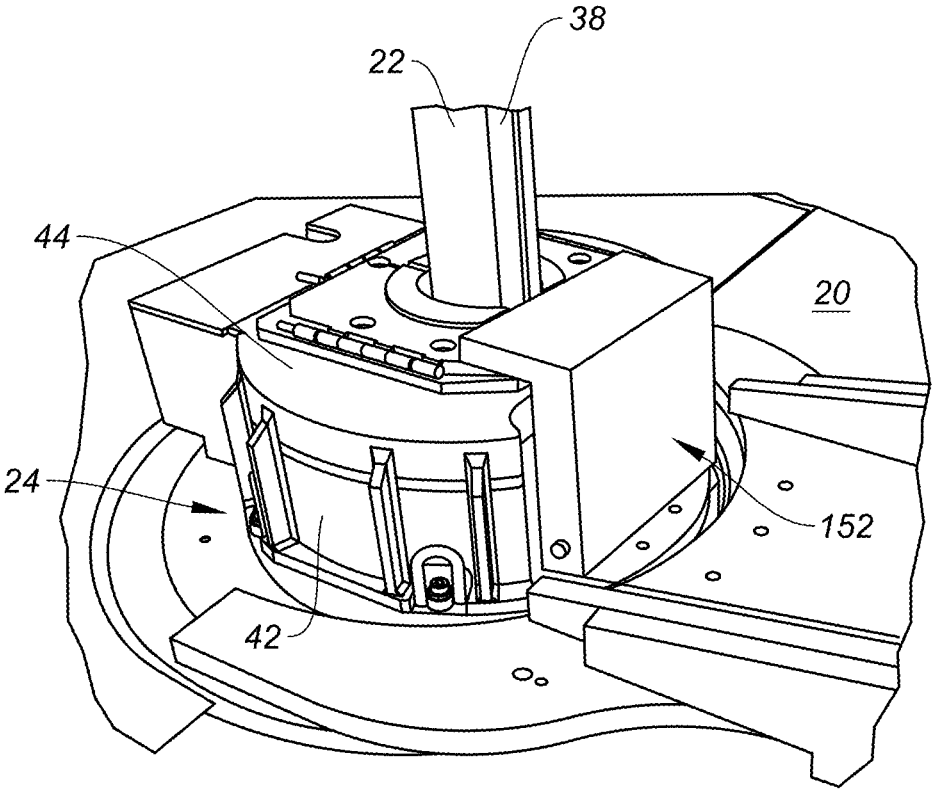
FIG. 7 is a diagrammatic view of a present disclosure shroud system embodiment.
Figure 8:
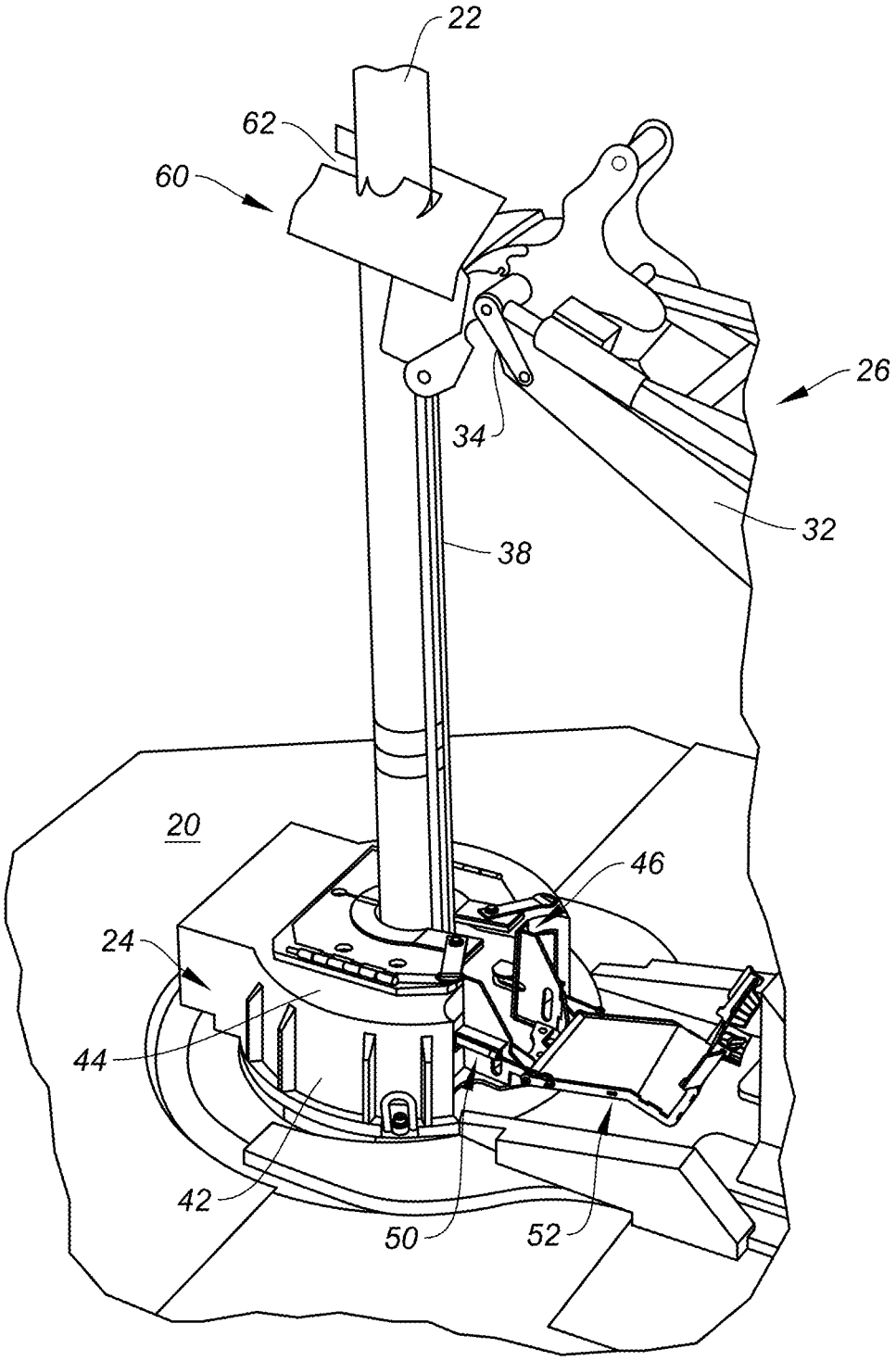
FIGS. 8 and 9 are diagrammatic views of a present disclosure shroud system embodiment.

Referring to FIGS. 4-6, an example of shroud system element is shown that includes a cover frame 50 and a cover door 52. As will be detailed herein, the cover door 52 is configured to pivot between a closed position (shown in FIGS. 4 and 6) and an open position (shown in FIG. 5). In the closed position, the cover door 52 substantially covers an access opening 54 (see FIG. 5) defined by the cover frame 50 (detailed herein) and collectively the cover frame 50 and the cover door 52 substantially covers all the spider door pocket 46. The cover frame 50 and cover door 52 embodiments described herein are non-limiting examples of structure that may be used to shroud the spider door pocket 46 and the present disclosure is not limited to these specific embodiments. Referring to FIG. 7, an embodiment of the present disclosure tubular string shroud system 49 is shown that includes a pivotally mounted cover door 152 and does not include a cover frame. The cover door 152 may actuate in the same manner as the cover door 52 utilized with the cover frame 50 as shown in FIGS. 4-6.

Referring to FIG. 5, in some embodiments the cover frame 50 may include a first lateral side panel 50A, a second lateral side panel 50B, a first enclosure panel 50C, and a second enclosure panel 50D. The first lateral side panel 50A is disposed to engage with the spider 24 on the first lateral side 46A of the spider door pocket 46 and the second lateral side panel 50B is disposed to engage with the spider 24 on the second lateral side 46B of the spider door pocket 46. The first enclosure panel 50C is attached to the first lateral side panel 50A. The second enclosure panel 50D is attached to the second lateral side panel 50B. Collectively, the first and second enclosure panels 50C, 50D define the access opening 54 to an interior region of the spider 24.

Still referring to FIG. 5, the cover door 52 includes a wall section 52A, a top section 52B, a base end 52C, and a distal end 52D. The wall section 52A of the cover frame door 52 is pivotally attached to the cover frame 50 adjacent the base end 52C. The top section 52B may be "L" shaped. In the closed position (e.g., as shown in FIGS. 4 and 6), the wall section 52A covers at least a portion of the wall portion 46C of the spider door pocket 46. The top section 52B transitions from covering a portion of the wall portion 46C of the door pocket 46 to covering at least a portion of the top panel portion 46D of the spider door pocket 46.

In the embodiment shown in FIGS. 4-6, actuators 56 are used to rotate the cover door 52 between the closed position (shown in FIGS. 4 and 6) and the open position (shown in FIG. 5). The present disclosure does not require cover frame door actuators 56 and when included, is not limited to any particular type or configuration of actuators 56. In those embodiments that include cover door actuators 56, the cover frame 50 may be configured (e.g., include actuator slots, brackets, and the like) to facilitate mounting and operating of the actuators 56.

The cover frame door 52 may be configured to mate with the cover frame 50 to facilitate shrouding of the spider door pocket 46 and thereby decrease (or eliminate) the possibility of foreign object incursion in the region surrounding the tubular string 22 and thereafter potentially falling through the well platform structure 20.

Referring to FIGS. 4-6, in some embodiments a seal member 58 (e.g., a flexible member) may be attached to the top section 52B of the cover door 52. In the cover door 52 closed position, a portion of the seal member 58 may be engaged with the tubular string 22 to shroud at least a portion of the perimeter of the tubular string 22. The seal member 58 may be formed from elastic members (e.g., polymeric materials, rubber materials, or the like) that can be biased against the tubular string 22. The present disclosure is not limited to any particular seal member 58 configuration.

Figure 9:
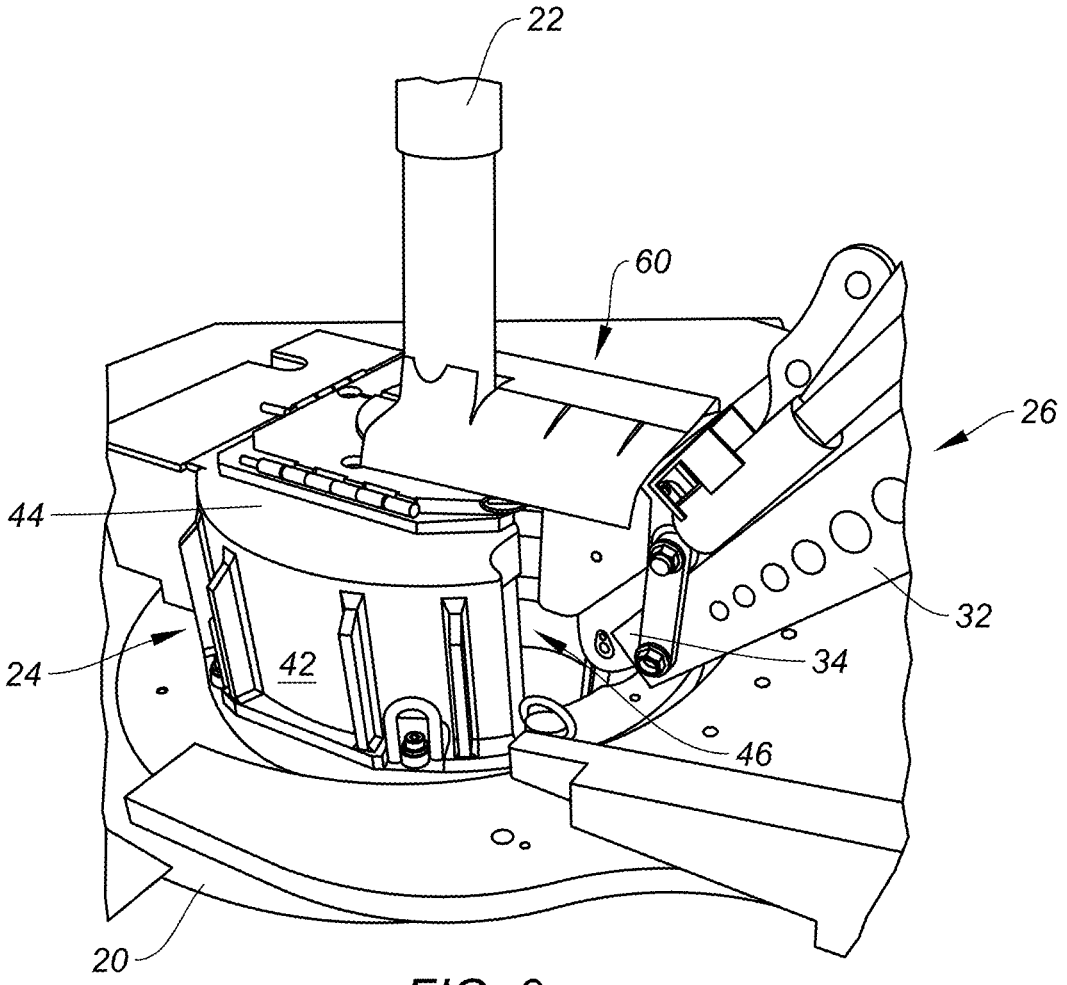

FIGS. 8-13 illustrate additional embodiments of present disclosure shroud system 49. In these embodiments, a seal member 60 may be attached to the distal end of the arm 32 of the CLMA 26, and may be configured to surround at least a portion of the tubular string 22. The seal member 60 shown in FIG. 8 may be described as having a slot 62 configured to receive the tubular string 22. The seal member 60 is disposed on three sides of the tubular string 22. FIG. 9 illustrates the CLMA arm 32 disposed with the roller head 34 adjacent the spider 24 (i.e., a "docked" configuration) and a seal member 60 engaged with tubular string 22. As can be seen in FIG. 9, the seal member 60 shrouds a substantial portion of the tubular string 22 perimeter and shrouds the spider door pocket 46 portion of the spider 24, at a time when cover frame door 52 is in an open position.

Figure 10:
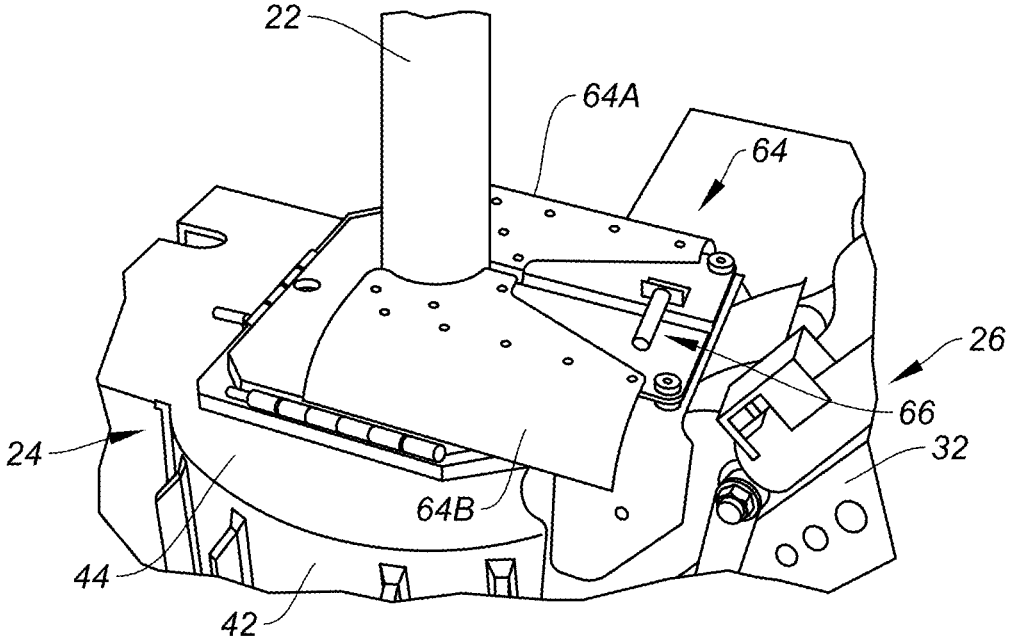
FIGS. 10-13 are diagrammatic views of a present disclosure shroud system embodiment.
Figure 11:
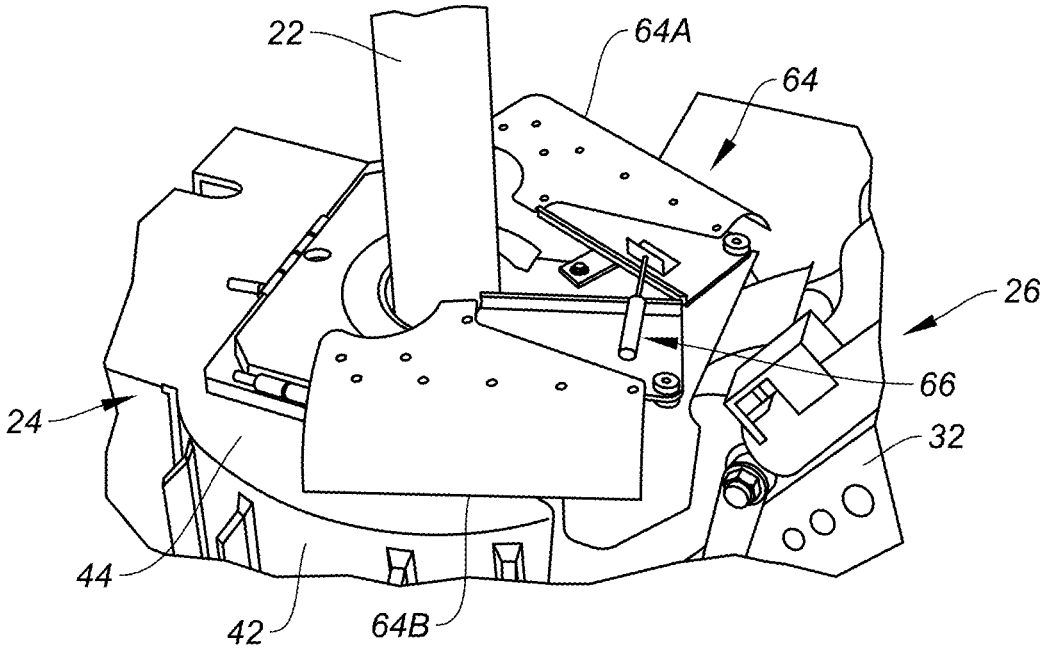
Figure 12:
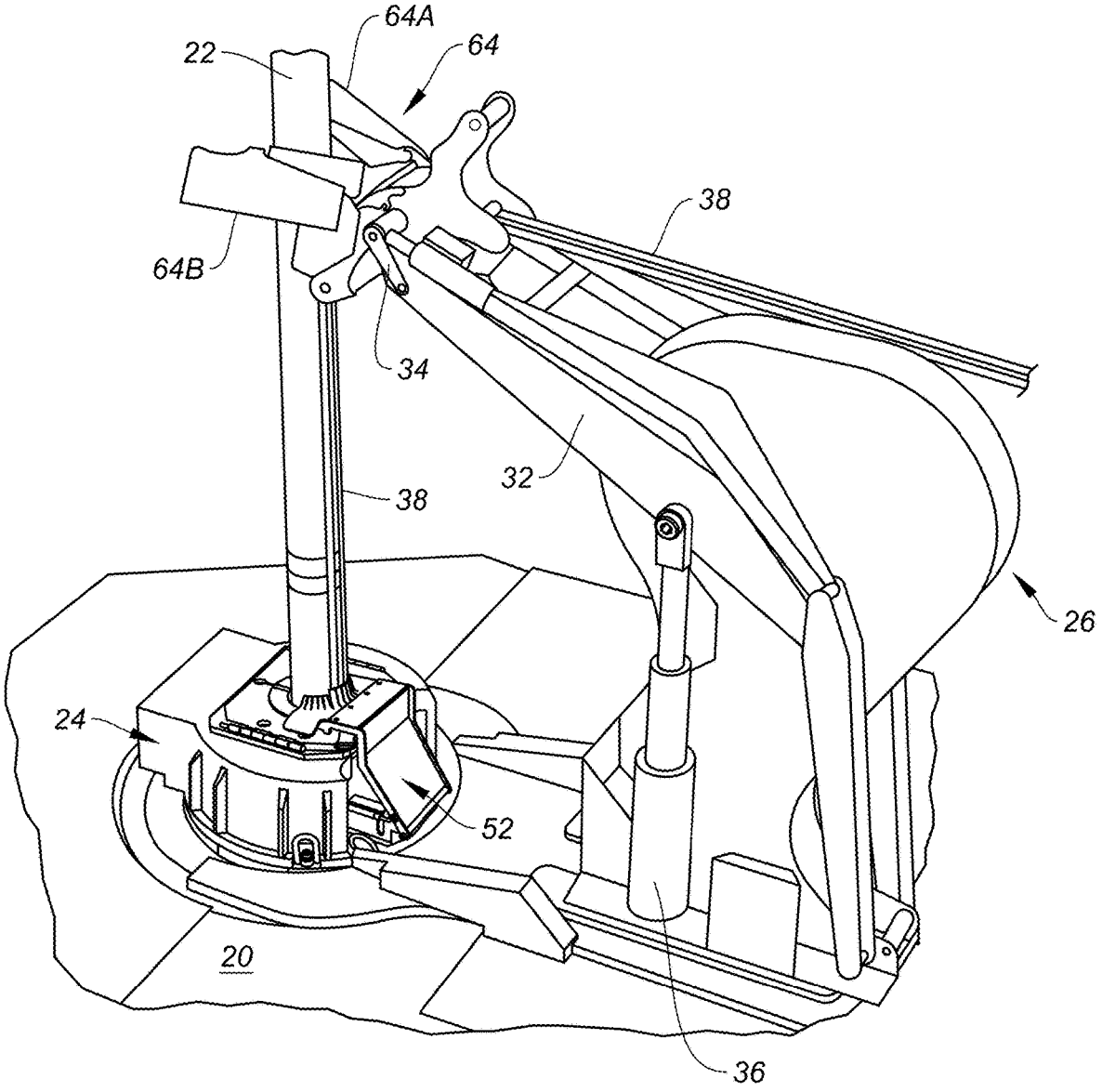
Figure 13:
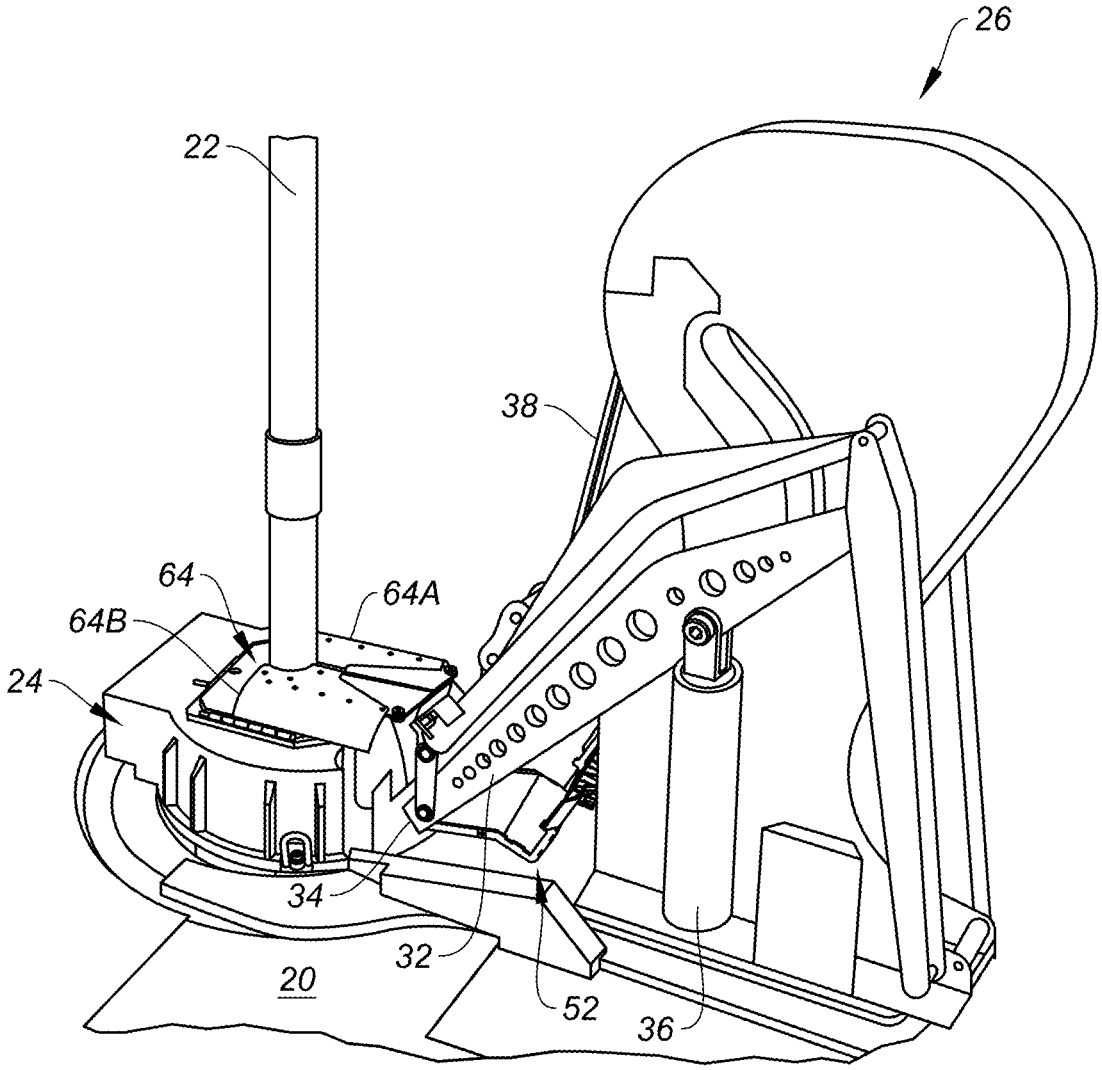

FIGS. 10-13 illustrate another seal member embodiment attached to the distal end of the arm 32 of the CLMA 26. In this embodiment, the seal member 64 includes a pair of seal member segments 64A, 64B that are pivotable between a closed position (e.g., see FIGS. 10 and 13) and an open position (e.g., see FIGS. 11 and 12). The seal member segments 64A, 64B may be contoured to mate with the tubular string 22. In the closed position, the seal member segments 64A, 64B are pivoted into engagement with the tubular string 22 thereby shrouding both the spider door pocket 46 portion of the spider 24 and a substantial portion of the tubular string 22 perimeter. In the open position, the seal member segments 64A, 64B are pivoted away from the tubular string 22 and therefore disengaged with the tubular string 22. In the open position, the seal member 64 still shrouds a portion of the spider door pocket 46 portion of the spider 24. FIGS. 10, 11, and 13 illustrates the CLMA arm 32 disposed with the roller head 34 adjacent the spider 24 (i.e., "nested" or "docked"). FIG. 12 illustrates the CLMA arm 32 disposed in the "arm-up" configuration.

In some embodiments, actuation of the seal member 64 between the open and closed positions may be accomplished by an controllable actuator 66. An actuator 66 is diagrammatically illustrated in FIGS. 10 and 11 to illustrate an actuator example. The present disclosure is not limited to any particular seal member actuator configuration.

The present disclosure tubular string shroud system 49 is detailed herein as having a plurality of different elements; e.g., a shroud system element that is attached to the spider 24 as shown in FIGS. 4-7 and a shroud system element that is attached to the CLMA arm 32 as shown in FIGS. 8-13. These shroud system elements may be used independent of one another or that may be used in combination with one another, so that the door pocket 46 is protected while arm 32 is either up or down.

The above described tubular string shroud system 49 is well-suited to use in an automated process; e.g., a "hands-free" process. A person of skill in the art will recognize that the process of preparing and inserting tubular strings 22 (and attached control lines 38 where applicable) into a well casing 28 has historically been a labor intensive and therefore expensive practice. In addition, the region surrounding the tubular string 22 is a hazardous area. The present disclosure shroud system 49 that can be utilized in a semi-automated or fully automated system may permit the tubular string 22 preparation/insertion process to be performed with decreased opportunity for foreign object incursion through the well platform structure 20, and may permit the preparation and insertion of a tubular string 22 with fewer technicians than historically used.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc.

The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112 (f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements. It is further noted that various method or process steps for embodiments of the present disclosure are described herein. The description may present method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible.

The invention claimed is:

1. A shroud system for a tubular string clamping device on a well platform, the clamping device having a door pocket, the shroud system comprising:

a cover frame configured to engage with the door pocket of the clamping device, and the cover frame is configured to define an access opening relative to the door pocket for access to an interior of the tubular string clamping device; and a cover door that is pivotally attached to the cover frame, wherein the cover door is pivotable between an open position and a closed position;

wherein the cover frame and the cover door are configured such that in the open position the access opening is uncovered thereby providing a passage through the door pocket and into the interior of the tubular string clamping device, and wherein in the closed position access opening is covered by the cover door.

2. The shroud system of claim 1, wherein the cover frame includes a first enclosure panel disposed on a first lateral side of the access opening, and a second enclosure panel that is disposed on a second lateral side of the access opening.

3. The shroud system of claim 2, wherein the cover frame includes a first lateral side panel that is attached to the first enclosure panel and that extends laterally outward from the first enclosure panel, and a second lateral side panel that is attached to the second enclosure panel and that extends laterally outward from the second enclosure panel.

4. The shroud system of claim 3, wherein the cover door extends between the first enclosure panel and the second enclosure panel.

5. The shroud system of claim 1, wherein the cover frame includes a first lateral side panel that extends in a first lateral direction from the access opening and a second lateral side panel that extends in a second lateral direction from the access opening.

6. The shroud system of claim 1, wherein the cover door includes a base end and a distal end, wherein the cover door is pivotally attached to the cover frame adjacent the base end.

7. The shroud system of claim 6, wherein the cover door includes a wall section and a top section;

wherein the wall section extends from the base end to the top section, and the top section extends from the wall section to the distal end;

wherein in the closed position, the wall section covers at least a portion of a wall portion of the access opening and the top section covers at least a portion of a top portion of the access opening.

8. The shroud system of claim 6, further comprising a flexible member attached to the distal end, wherein the flexible member is configured to engage with a tubular string disposed within the tubular string clamping device when the cover door is disposed in the closed position.

9. The shroud system of claim 1, further comprising a seal member configured to engage with a tubular string disposed within the tubular string clamping device when the cover door is disposed in the closed position.

10. The shroud system of claim 1, further comprising an actuator that is controllable to pivot the cover door between the open position and the closed position.

11. A shroud system for a well drilling platform system, the well drilling platform system including a tubular string clamping device and a control line manipulating arm (CLMA) device, wherein the tubular string clamping device has a door pocket and is controllable to clamp a tubular string, and the CLMA device includes an arm that may be pivoted between an arm-up configuration and a docked configuration, the shroud system comprising:

a clamping device shroud that includes:

a cover frame configured to engage with the door pocket of the clamping device, and the cover frame is configured to define an access opening relative to the door pocket for access to an interior of the tubular string clamping device; and a cover door that is pivotally attached to the cover frame, wherein the cover door is pivotable between an open position and a closed position;

wherein the cover frame and the cover door are configured such that in the open position the access opening is uncovered thereby providing a passage through the door pocket and into the interior of the tubular string clamping device, and wherein in the closed position access opening is covered by the cover door; and a seal device attached to the arm of the CLMA device, wherein the seal device is configured to engage with a tubular string disposed within the tubular string clamping device when the arm of the CLMA device is disposed in the docked configuration.

12. The shroud system of claim 11, wherein the seal device is disengaged with the tubular string when the arm of the CLMA device is disposed in the arm-up configuration.

13. The shroud system of claim 12, wherein the seal device includes a slot that is configured to receive the tubular string when the arm of the CLMA device is in the docked configuration.

14. The shroud system of claim 10, wherein the seal device includes a first seal segment and a second seal segment that are configured to be disposed in a closed configuration in which the first seal segment and the second seal segment are engaged with the tubular string, or in an open configuration in which the first seal segment and the second seal segment are not engaged with the tubular string.

15. The shroud system of claim 14, wherein the first seal segment and the second seal segment are pivotally mounted and are configured to pivot between the closed configuration and the open configuration.

16. The shroud system of claim 15, further comprising a seal member actuator that is controllable to actuate the first seal segment and the second seal segment between the closed configuration and the open configuration.

17. The shroud system of claim 11, wherein the cover door includes a wall section and a top section;

wherein the wall section extends from the base end to the top section, and the top section extends from the wall section to the distal end;

wherein in the closed position, the wall section covers at least a portion of a wall portion of the access opening and the top section covers at least a portion of a top portion of the access opening.

18. The shroud system of claim 11, further comprising a flexible member attached to the cover door, wherein the flexible member is configured to engage with the tubular string disposed within the tubular string clamping device when the cover door is disposed in the closed position.

19. The shroud system of claim 11, further comprising an actuator that is controllable to pivot the cover door between the open position and the closed position.

20. A shroud system for a tubular string clamping device on a well platform, the clamping device having a door pocket, the shroud system comprising:

a pivotally mounted cover door that is L-shaped and is disposable in an open position and in a closed position, wherein in the open position the L-shaped cover door is pivoted away from an outer side wall portion of the tubular string clamping device and the door pocket is uncovered thereby providing a passage through the door pocket and into an interior of the tubular string clamping device, and in the closed position the cover door is disposed to cover the door pocket; and an actuator controllable to actuate the cover door between the open position and the closed position.

* * * * *